US012569056B2

(12) United States Patent
Park

(10) Patent No.: US 12,569,056 B2
(45) Date of Patent: Mar. 10, 2026

(54) SPIRAL COSMETIC APPLICATOR WITH DOWNWARD FACING MICROCOMBS

(71) Applicant: L'Oreal, Paris (FR)

(72) Inventor: Kyoo Jin Park, Leonia, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 17/491,315

(22) Filed: Sep. 30, 2021

(65) Prior Publication Data

US 2022/0133023 A1 May 5, 2022

Related U.S. Application Data

(60) Provisional application No. 63/107,814, filed on Oct. 30, 2020.

(30) Foreign Application Priority Data

Dec. 3, 2020 (FR) ..... 2012608

(51) Int. Cl.
*A46B 9/02* (2006.01)
*A45D 40/26* (2006.01)
*A46D 3/00* (2006.01)

(52) U.S. Cl.
CPC ..... *A46B 9/021* (2013.01); *A45D 40/262* (2013.01); *A46D 3/00* (2013.01); *A46B 2200/106* (2013.01)

(58) Field of Classification Search
CPC .. A45D 40/262; A45D 40/265; A45D 40/267; A45D 2200/10; A46B 3/005; A46B 3/00; A46B 9/02; A46B 9/021; A46B 9/025; A46B 2200/1053; A46B 2200/106
See application file for complete search history.

(56) References Cited

U.S. PATENT DOCUMENTS

| | | | | |
|---|---|---|---|---|
| 9,492,002 | B2 | 11/2016 | Malvar et al. | |
| 9,560,904 | B2 | 2/2017 | Jollet | |
| 2008/0083421 | A1* | 4/2008 | Malvar | A45D 40/267 15/207.2 |

(Continued)

FOREIGN PATENT DOCUMENTS

| | | | |
|---|---|---|---|
| FR | 3070840 | A1 | 3/2019 |
| IT | MI20082197 | T | 6/2010 |
| WO | 2020127707 | A1 | 6/2020 |

OTHER PUBLICATIONS

Preliminary Search Report mailed Aug. 2, 2021, issued in corresponding French Application No. 2012608, filed Dec. 3, 2020, 2 pages.

(Continued)

*Primary Examiner* — Rachel R Steitz
(74) *Attorney, Agent, or Firm* — CHRISTENSEN O'CONNOR JOHNSON KINDNESS PLLC

(57) ABSTRACT

An applicator for applying a cosmetic product to the eyelashes and/or eyebrows. The applicator includes a core extending along a longitudinal axis X, and one or more elongated strip having a top planar surface with a plurality of bristles extending therefrom. The one or more elongated strip is wrapped in a helical pattern around the longitudinal axis X of the core. Each of the plurality of bristles have a bristle latitudinal axis Y and one or more branches extending at a downward angle θ from the bristle latitudinal axis Y.

22 Claims, 8 Drawing Sheets

(56) References Cited

U.S. PATENT DOCUMENTS

| | | | | |
|---|---|---|---|---|
| 2015/0250293 | A1* | 9/2015 | Hauger | A45D 40/262<br>401/129 |
| 2015/0335133 | A1* | 11/2015 | Kim | A46B 9/021<br>401/118 |
| 2017/0020274 | A1* | 1/2017 | De Bardonneche | A46D 1/0253 |
| 2017/0258213 | A1 | 9/2017 | Lee | |
| 2019/0298050 | A1* | 10/2019 | Berhault | A45D 40/265 |
| 2020/0214435 | A1* | 7/2020 | Schreiber | A45D 40/265 |

OTHER PUBLICATIONS

Written Opinion mailed Aug. 2, 2021, issued in corresponding French Application No. 2012608, filed Dec. 3, 2020, 4 pages.

* cited by examiner

SPIRAL COSMETIC APPLICATOR WITH DOWNWARD FACING MICROCOMBS

CROSS-REFERENCES TO RELATED APPLICATIONS

This application claims the benefit of U.S. Provisional Application No. 63/107,814, filed Oct. 30, 2020, and French Application No. 2012608, filed Dec. 3, 2020, the disclosures of which are expressly incorporated herein by reference in their entirety.

SUMMARY

Spiral cosmetic applicators with downward facing microcombs/branches, and methods of making same, are provided. Downward facing microcombs are formed integral with bristles spirally arranged on a central core, acting as "hooks" to capture a user's lashes and cause the lashes to extend down into the core of the brush as the lashes pass through the downward facing branches and along the bristles.

According to one aspect, an applicator for applying a cosmetic product to the eyelashes and/or eyebrows is provided, comprising a core extending along a longitudinal axis X and one or more elongated strip having a top planar surface with a plurality of bristles extending therefrom. The one or more elongated strip is wrapped in a helical pattern around the longitudinal axis X of the core. Each of the plurality of bristles have a bristle latitudinal axis Y and comprise one or more branches extending at a downward angle θ from the bristle latitudinal axis Y. Preferably, the downward angle θ is ≤90 degrees. Alternatively, the downward angle θ ranges from between about 45 degrees to about 80 degrees.

In an embodiment, the one or more branches comprise at least three branches; preferably at least four branches. Another embodiment provides that the one or more branches are linear. Preferably, the one or more branches are curved to form hooks.

In an embodiment, the one or more branches are uniform and located on only one same side of each of the plurality of bristles. Preferably, the one or more branches face the same direction. In another embodiment, the one or more branches alternate facing directions along in neighboring helical rows forming the helical pattern.

In an embodiment, each of the bristles of the plurality of bristles have a diameter ranging from 0.2 mm to 0.8 mm, preferably between 0.3 mm to 0.5 mm.

In an embodiment, the one or more branches have a cross-section length extending from the bristle ranging from 0.5 mm to 2.5 mm, preferably between 1 mm to 1.5 mm.

In an embodiment, the one or more branches have a thickness ranging from 0.2 mm to 0.8 mm, preferably between 0.3 mm to 0.5 mm.

Preferably, though not necessarily, the one or more elongated strip is a single elongated strip.

In an embodiment, the one or more elongated strip, bristles and branches are composed of a single material. Alternatively, in an embodiment the one or more elongated strip, bristles and branches are composed of two or more materials. Two or more materials having different softness or flexibility properties may be used in making the subject applicator.

In an embodiment, the plurality of bristles each extend from the top planar surface of the one or more elongated strip at an angle ¢ between the bristle latitudinal axis Y and the top planar surface.

In yet another embodiment, a helical gap extends along the longitudinal axis X formed alternating with the rows of the bristles.

In an embodiment, one or more components of the applicator are made by 3-D printing technology. One or more portions/components of the applicator may be a combination of elastomeric and 3-D printing.

In an embodiment, one or more components of the applicator are made by one of injection molding and/or bi-injection molding, and combinations thereof.

In an embodiment, the bristles are angled to the Z axis passing through the core at the bristle base by an angle α, preferably ranging between 45°. and 90°.

Another embodiment provides for an applicator for applying a cosmetic product to the eyelashes and/or eyebrows, comprising a core extending along a longitudinal axis X and one or more disks having a side wall planar surface with a plurality of bristles extending therefrom in a ring stacked upon one another around the longitudinal axis X of the core. Each of the plurality of bristles have a bristle latitudinal axis Y and comprise one or more branches extending at a downward angle θ from the bristle latitudinal axis Y.

An embodiment is directed to an applicator for applying a cosmetic product to the eyelashes and/or eyebrows, comprising a core extending along a longitudinal axis X, and a plurality of bristles extending therefrom having a bristle latitudinal axis Y and comprising one or more branches extending at a downward angle θ from the bristle latitudinal axis Y.

Yet another embodiment provides a method for making an applicator for applying a cosmetic product to the eyelashes and/or eyebrows, comprising the steps of, in no particular order, forming a core extending along a longitudinal axis X, forming one or more elongated strip having a top planar surface with a plurality of bristles extending therefrom, each of the plurality of bristles having a bristle latitudinal axis Y and comprising one or more branches extending at a downward angle θ from the bristle latitudinal axis Y, and wrapping the one or more elongated strip in a helical pattern around the longitudinal axis X of the core.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and advantages of the inventive technology will become more readily appreciated as the same become better understood by reference to the following detailed description, when taken in conjunction with the accompanying drawings, wherein:

FIG. 7 shows an embodiment of orientations ZX/XY/YZ with downward angle θ orientation of the one or more branches, and shows the branches formed as hooks/hook like;

DETAILED DESCRIPTION

Figure 1:
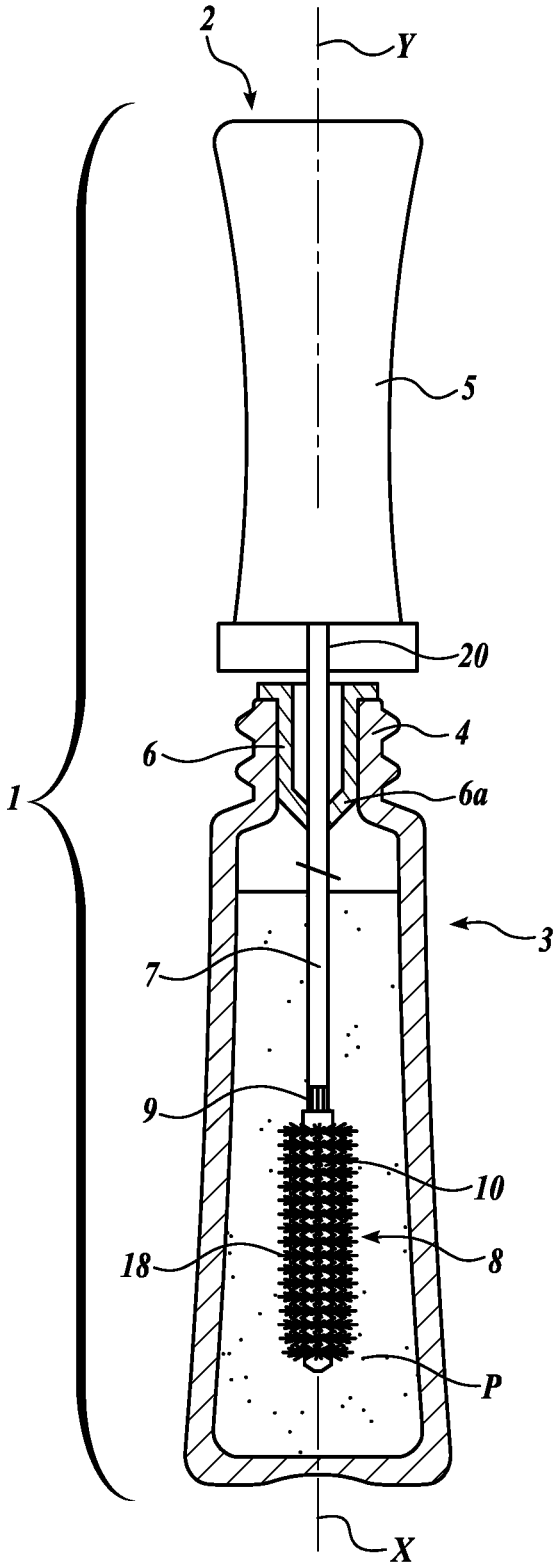
FIG. 1 shows a top plan view of an application and packaging device according to the invention.

Mascara application and performance is closely related to the configuration of the bristles arrangement and configuration of the applicator device. Traditional bristles are typically conical or cylindrical with a smooth surface. Other bristles generally provide spiked or branched tines or bristles, however these configurations frequently cause unwanted pulling and movement of the lashes, and fail to increase mascara deposit as the lash passes over the spikes or branches of the tines.

The subject spiral applicator for applying a cosmetic product to the eyelashes and/or eyebrows includes a core extending along a longitudinal axis X, and one or more elongated strip having a top planar surface with a plurality of bristles extending therefrom. The one or more elongated strip is wrapped in a helical pattern around the longitudinal axis X of the core. Each of the plurality of bristles have a bristle latitudinal axis Y and one or more branches extending at a downward angle θ from the bristle latitudinal axis Y.

This unique elongated strip technology, bristle shape and orientation of the multiple downward facing branches on each individual bristle facing in an aligned orientation longitudinally along the core provides space for the mascara to be reserved for deposit on the lashes, while also providing means to separate clumps. It has been found that the combination of the orientation of the downward facing branches and the branch arrangement on the bristle results in a lengthening of the lashes, and full surface area contact along the length of each lash without tangling or pulling.

Downward orientation of the microcombs or branches of the bristles of the subject spiral applicator has been found to result in an increase deposition of mascara, while improving the combing effect along the lashes.

For nomenclature purposes, wherein the X axis be the body of the brush/horizontal or longitudinal central axis, wherein the Y axis is vertical or latitudinal, and wherein the Z axis intersects with the y-axis and x-axis at the origin for front to back (three dimensional). While traditional brushes generally can only be formed in at angles and shape substantially along the XY plane, or at limited angles along the XY plane, the subject applicator allows for bristle configurations on the YZ plane, rather than XY. This is significant as the lashes enter the brush relatively perpendicular to the XY plane. When unique bristles are on the XY plane, they collide with lashes rather than letting them enter. However, when bristles are formed on YZ plane, as in the case of the subject applicator, the XY plane is free of any obstacles hence making it easier for lashes to enter, resulting in improved deposit with greater lash to bristle surface area contact for a greater amount of time as the lash extends full length across the bristle and/or branches thereon.

The bristles preferably have a diameter ranging from 0.2 mm to 0.8 mm, preferably between 0.3 mm to 0.5 mm. The bristles may have a bristle base (distal end) that has a greater diameter than the top (proximal end) of the bristle.

Preferably, the subject branches have an orientation ≤90 deg./perpendicular to the central axis of the bristle. It has been found the microcomb/branch angulation ≤90 degrees or even parallel to the central axis of the bristle results in decreased deposition as the lashes do not fully cross over the branches.

The subject spiral applicator provides increase in volume to separation ratio (i.e. a brush could have larger volume but not match the level of separation). Existing manufacture of elastomeric brushes or fiber brushes generally fails to create unique shaped bristles facing the angle that is beneficial for mascara applications. Traditional brush bristles generally can only be shaped along the XY plane. However, the subject spiral applicator utilizes elongated strip technology to provide bristle configurations on the YZ plane, rather than the XY plane. Alternatively, disk technology may be used. This is significant as the lashes enter the brush relatively perpendicular to the XY plane. While other bristles on the XY plane frequently collide with lashes rather than letting them enter, the subject novel spiral applicator's bristle orientation and construction formed on the YZ plane, is free of any obstacles, hence making it easier for lashes to enter.

The branches/hook portions are angled substantially perpendicular to the body length of the brush. Preferably, there are multiple downward facing branches/hooks; more preferably there are three or more branches. Dimensions of the bristles preferably range about 0.2 mm to 0.8 mm, preferably between about 0.3 mm to 0.5 mm.

Preferably, the subject spiral applicator is made by way of elongated strip or strip technology. Alternatively, the brush may be made by way of disk technology, and/or 3-D printing.

The one or more branches preferably have a thickness ranging from 0.2 mm to 0.8 mm, preferably between 0.3 mm to 0.5 mm. Distance between subsequent branches/hooks is preferably between 0.2 mm to 1.2 mm. The hooks will extend from the main body of the bristle between 0.2 mm to 1 mm in length. Number of hooks can be between 2 and 6, most preferably 3 to 4. Then distance between subsequent hooks can be between 0.8 mm to 2 mm. The subject brush can also be bi-injected to provide different level of flexibility within each bristle which help in delivering better mascara delivery results. The one or more branches have a cross-section length extending from the bristle ranging from 0.5 mm to 2.5 mm, preferably between 1 mm to 1.5 mm.

The subject bristles include one or more downward facing microcombs/branches forming "hook-like" appendages on the bristles in an angled arrangement so that each lash passes through the hook-like downward facing microcomb. Branches are arranged angled from the center axis of bristles ranging from perpendicular to +/−20 degree angles away from the body length of the brush/away from the body length of the brush. Preferably, there are at least two branches or hooks. The bristle may include a plurality of branches or hooks. Preferably, all branches or hooks face downward, and face in the same orientation along the same side of each bristle.

Preferably, the spiral cosmetic applicator with downward facing branches/microcombs is made using elongated strip brush technology, wherein the plurality of bristles with downward facing microcombs are arranged on an elongated strip/ribbon forming a ribbon/strip of molded bristles that is spiral wrapped onto a shaft or core to create a helical pattern or spiral pattern brush.

FIG. 1 shows a packaging and application device 1 appointed for use with the applicator of the subject invention, comprising an applicator 2 and an associated container 3 containing a product P to be applied to the eyelashes and/or eyebrows, for example mascara or a care product. The container 3 comprises, in the example in question, a threaded neck 4 and the applicator 2 comprises a closure cap 5 designed to be fastened on the neck 4 so as to close 15 the container 3 in a sealed manner when it is not in use, the closure cap 5 also constituting a gripping member for the applicator 2. The container 3 may also be produced differently.

The container 3 also comprises a wiping member 6, for example inserted into the neck 4. This wiping member 6, which may be any wiping member, comprises, in the figure shown, a lip designed to wipe the stem 7 and the applicator member 8 when the applicator 2 is withdrawn from the container 3. The lip defines a wiping orifice 6*a* having a diameter adapted to that of the stem. The wiping member 6 may be made of elastomer. The wiping member 6 may comprise a wiping orifice 6*a* with a circular shape, optionally with slots. The diameter of the wiping orifice 6*a* of the wiping member 6 is for example between 2.5 and 6 mm, being for example around 3.5 mm or 5 mm. The wiping member 6 may optionally have undulations, allowing the wiping orifice to widen more easily when the applicator member 8 passes through. The wiping member may also be adjustable, if appropriate.

The applicator 2 comprises a stem 7 of longitudinal axis Y, which is attached at its upper end to the closure cap 5 and at its lower end to an applicator member 8. The latter comprises a core 10 bearing bristles 18 that extend from the core 10 and all around the latter. Preferably, as shown, the stem 7 has a circular cross section, but it would not constitute a departure from the scope of the present invention if the stem 7 had a different cross section, it then being possible to fasten the cap 5 on the container 3 in some other way than by screwing, if necessary. The wiping member 6 is adapted to the shape of the stem 7 and to that of the applicator member 8, if appropriate.

Preferably, the longitudinal axis Y of the stem 7 is rectilinear and coincident with the longitudinal axis of the container 3 when the applicator 2 is in place thereon, but it would not constitute a departure from the scope of the present invention if the stem 7 were not rectilinear, forming for example an elbow. The stem 7 may have an annular narrowing at its portion that is positioned opposite the lip of the wiping member 6, so as not to mechanically stress the latter unduly during storage.

The stem 7, to which the applicator member 8 is fixed, may be at least partially, and in particular completely, flexible, in particular in the vicinity of the applicator member. The applicator member 8 may be fixed to the stem 7 by any means, and in particular by force-fitting, snap-fastening, adhesive bonding, welding, stapling or crimping, in a corresponding housing provided at the end of the stem 7.

Figure 2:
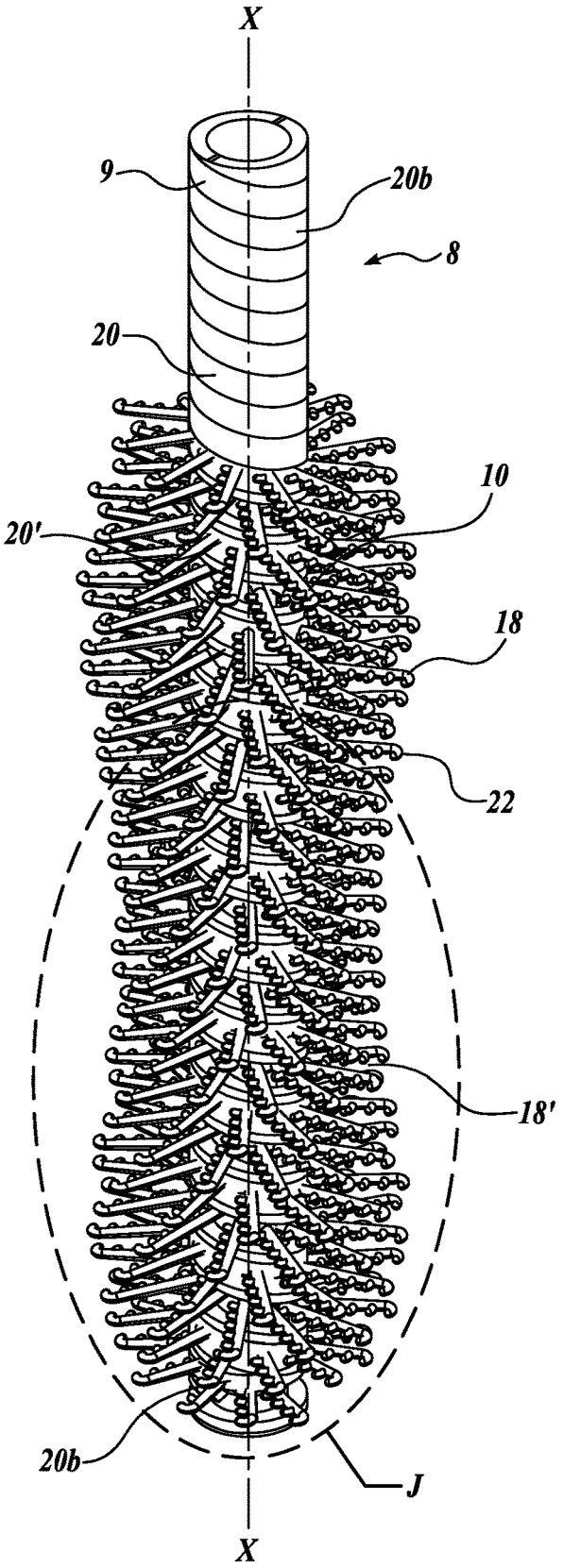
FIG. 2 is a top side view of the spiral applicator according to the invention.
Figure 3:
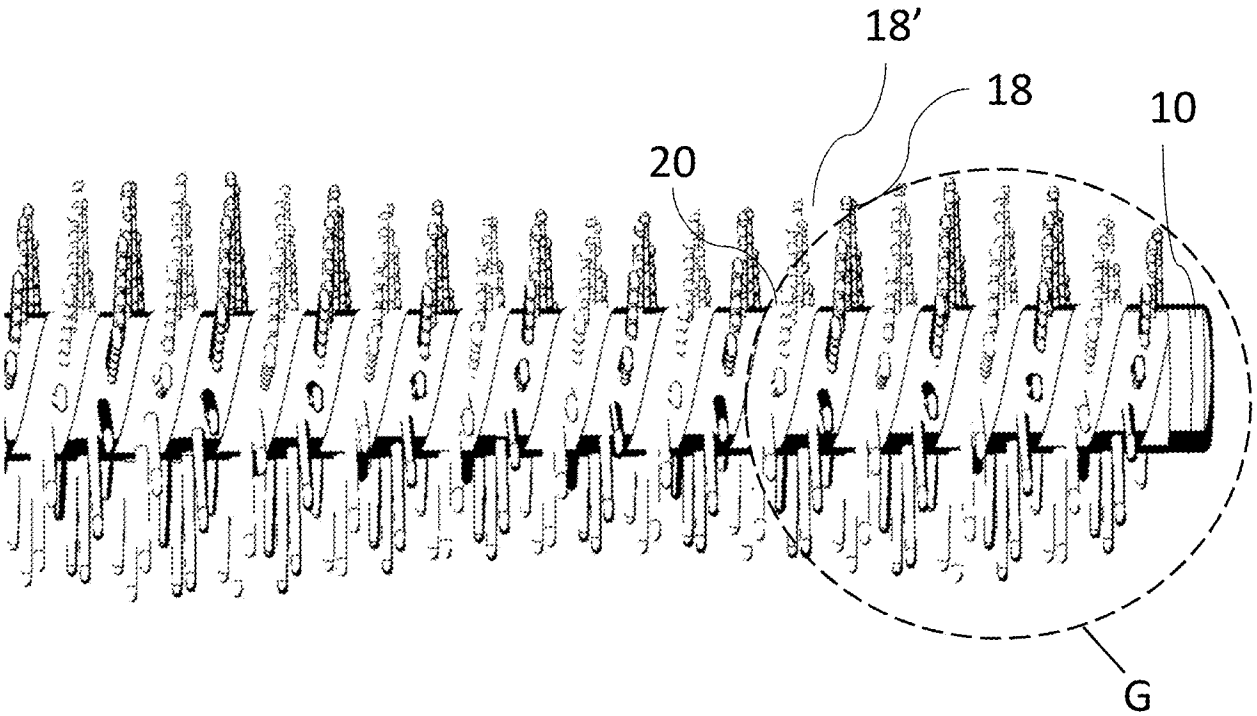
FIG. 3 is an exploded section view of the applicator of FIG. 2 taken at cross-section J showing a top plan view of the applicator according to the invention.

As shown in FIG. 2, the applicator member 8 may comprise an end piece 9 for fastening it in a corresponding housing in the stem 7. One example of an applicator member according to the invention will now be described with reference to FIGS. 2 to 7. Referring to FIGS. 2 to 7, the applicator member 8 comprises a core 10 extending along a longitudinal axis X with one or more elongated strip 20 having a top planar surface 21 with a plurality of bristles 18 extending therefrom. Elongated strip 20 is preferably a single elongated strip, which may be made of a single material, or made of more than one material with same or different physical properties. Elongated strip 20 is wrapped in a helical pattern around the longitudinal axis X of core 10.

Each of the plurality of bristles 18 have a bristle latitudinal axis Y and comprise one or more branches 22 extending at a downward angle θ from the bristle latitudinal axis Y. Preferably, the downward angle θ is 90 degrees [+/−20 degrees]. Alternatively, the downward angle θ ranges from about 35 degrees to about 90 degrees.

The core 10 is elongate along a longitudinal axis X. The longitudinal axis X is rectilinear but, as an alternative, could have any other shape, in particular curved. The longitudinal axis X is central, but this could be different. The length H of the core 10 is, for example, between 15 mm and 27 mm.

In the embodiment shown, core 10 is spiral wrapped by an elongated strip or strip 20 having a proximal end 20*a*, main body 20*b*, a distal end 20*b*, and a top planar surface 20'. Along at least a portion of the main body 20*b* extending to the proximal end 20*a*, extends a row of the bristles 18, extending laterally therefrom. Spiral wrapping of elongated strip or strip 20 results in a helical pattern extending substantially along the length of core 10.

Elongated strip or strip 20 spirals or turns around the longitudinal axis of the core 10, turning around the axis X over multiple turns, in particular over more than 20 turns, for example, preferably over more than 30 turns. The number of turns corresponds to the width of the top planar surface 20' of the elongated strip or strip 20 and the length of the core.

Distal end 20*b* of elongated strip or strip 20 preferably does not include bristles or bristles 18, extending toward end piece 9.

Preferably, core 10 is spiral wrapped by a single elongated strip or strip 20, which continuously wraps around core 10, and axis X, at a constant pitch to form the helical pattern.

The bristles 18 extending around the core, each following the helical path of the elongated strip or strip 20. Elongated strip or strip 20 preferably has a width that is constant so that the rows of bristles 18 form gaps 18' there between local helices that are substantially constant. Preferably, proximal end 20*a* and main body 20*b* of elongated strip or strip 20 has a constant width "w", while distal end 20*b* may have a different width.

As an alternative, the core 10 may be a solid cylinder and the elongated strip or strip 20 surrounds the core 10. Alternatively, the elongated strip or strip 20 may form the core 10, each helical attaching or bonding to the neighboring helical.

Each elongated strip or strip 20 preferably comprises between 90 to 200 bristles or bristles 18. More preferably, each elongated strip or strip 20 includes between 100 to 180 bristles or bristles 18. Most preferably, each elongated strip 20 includes between 110 to 150 bristles 10. The number of bristles 18 that result in each helical row is dependent on the diameter of core 10 and the distance between bristles 18 on elongated strip or strip 20. The application bristles 18 are aligned with each other at their base along the elongated strip or strip 20, and visa via the formed helical corresponding row.

Bristles 18 extending along elongated strip or strip 20 have the same orientation, although the bristles 18 may alternate with different configurations.

Bristles 18 comprise a body 21 with the at least one bristle or microcomb 22 extending downward and laterally from body 21. Preferably, bristle 18 includes two or more bristles or microcombs 22. More preferably, bristle 18 includes at least three bristles or microcombs 22, most preferably four as shown.

The bristles 18 comprise a base 23*a* attached to elongated strip or strip 20, extending to a central portion 24, which in turn extends to tip 23*b*. Preferably, bristles 18 have a circular cross-section which may have a substantially constant diameter, or may instead have a greater diameter at the base 23*a* tapering toward tip 23*b* to form a conical shaped bristle or bristle 18.

Figure 7:
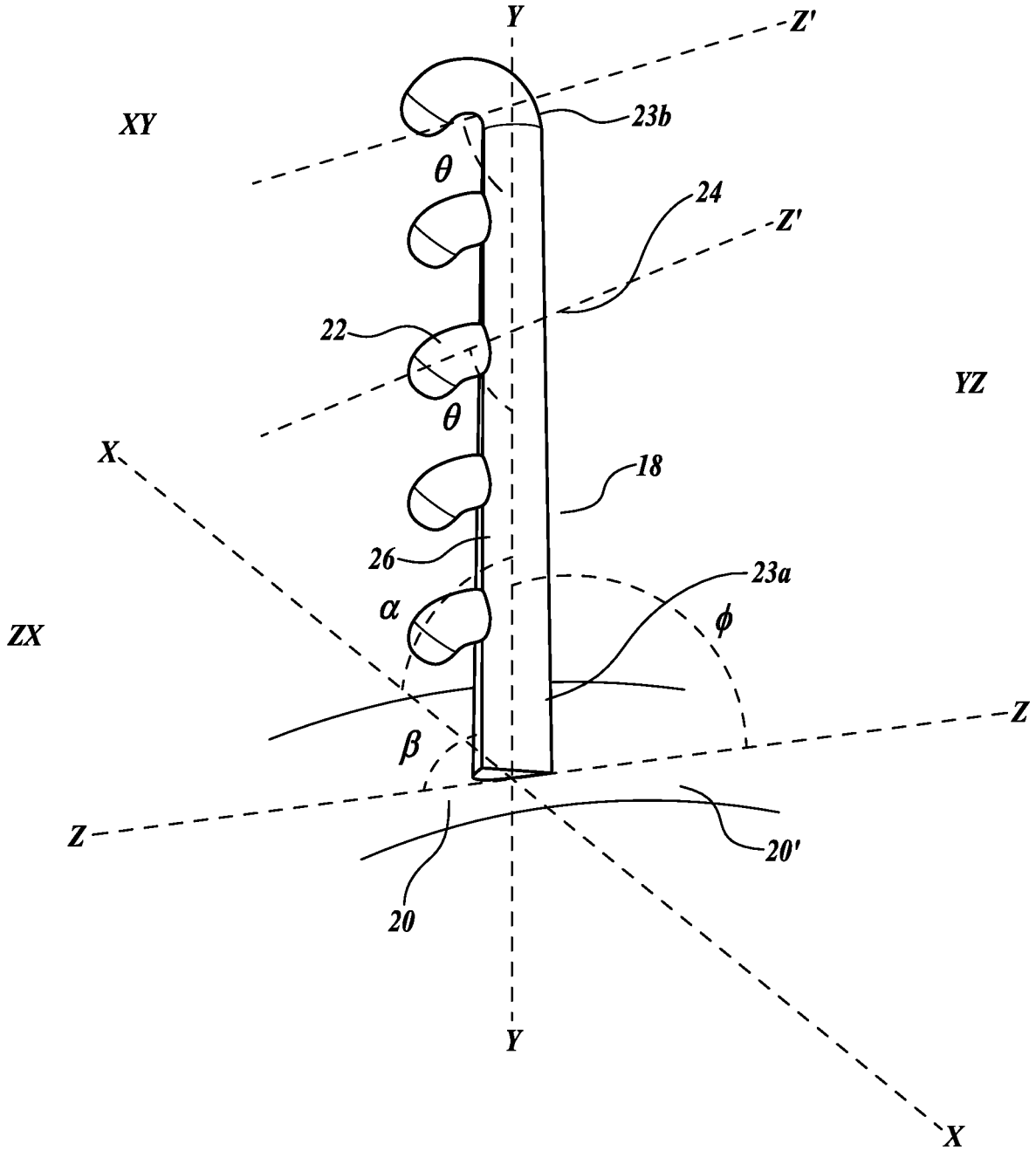

Bristles 18 include a bristle latitudinal axis Y extending centrally and latitudinal (or substantially on the vertical place) along the bristle 18 as best depicted in FIG. 7. The bristles 18 may be angled in relation to the top planar surface of the elongated strip or strip 20, or central core axis X. The X axis represents the body of the brush/horizontal or longitudinal central axis along the core; the Y axis is vertical or latitudinal along the length of each of the bristles; and the Z axis intersects with the y-axis and x-axis at the origin for front to back (three dimensional).

Along XY plane, each of the plurality of bristles having a bristle latitudinal axis Y and comprising one or more branches extending at a downward angle θ (along axis Z') from the bristle latitudinal axis Y (Z'Y plane). The downward angle θ is ≤90 degrees. Preferably, the downward angle θ ranges from between about 45 degrees to about 80 degrees. ZX plane angulation results in bristle angle relative to the longitudinal axis X at a bristle base along a bristle Z axis by an angle β, which preferably ranges from about between 5 and 30°. The plurality of bristles each extend from the top planar surface of the one or more elongated strip at an angle ϕ between the bristle latitudinal axis Y and the top planar surface (YZ plane). Bristles 18 are angled relative to Z axis passing through the core at the bristle base by an angle α, preferably ranging between 5 and 90° (XY plane).

Branches or microcombs 22 are preferably arched or curved. Preferably, the bristle or microcombs 22 have a thickness ranging from 0.2 mm to 0.8 mm, preferably between 0.3 mm to 0.5 mm a cross-section length extending from the bristle ranging from 0.5 mm to 2.5 mm, preferably between 1 mm to 1.5 mm; and a circular cross-section and/or thickness ranging from 0.2 mm to 0.8 mm, preferably between 0.3 mm to 0.5 mm. It is noted that the branches may have a circular cross-section, but do not necessarily have a circular cross-section.

These axis and vertices form ZX plane, XY plane and YZ plane in relation to the applicator, allowing for a plethora of bristle configurations on each of these planes. This is significant as the lashes enter the brush relatively perpendicular to the XY plane through gaps 18' (see FIG. 3), free of any obstacles hence making it easier for lashes to enter between the bristles and branches angled along the ZX and YZ planes. This results in improved deposit with greater lash to bristle surface area contact for a greater amount of time as the lash extends full length across the bristle and/or branches thereon.

Preferably, there are at least two bristles or microcombs 22 on each bristle 18. Most preferably, there are three to four bristles or microcombs 22. The bristles or microcombs 22 are located on a first side wall 26 of each of the bristles 18, all aligned with one another. There are no bristles or microcombs 22 are preferably only located along the first side wall 26 in the aligned configuration.

Microcombs 22 are preferably located on the central portion 24, and preferably extend from tip 23*b*, so that the bristles 18 form hook-like microcombs aligned axially along the bristle.

As shown, the microcombs 22 are all of substantially identical shape, but this does not have to be the case.

Figure 4:
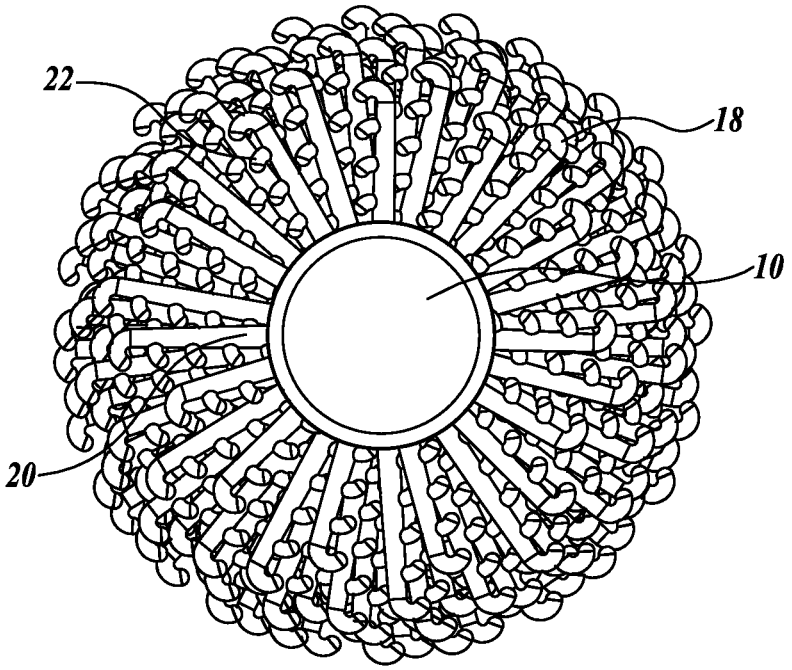
FIG. 4 is a top view of the spiral applicator of FIG. 2.
Figure 5:
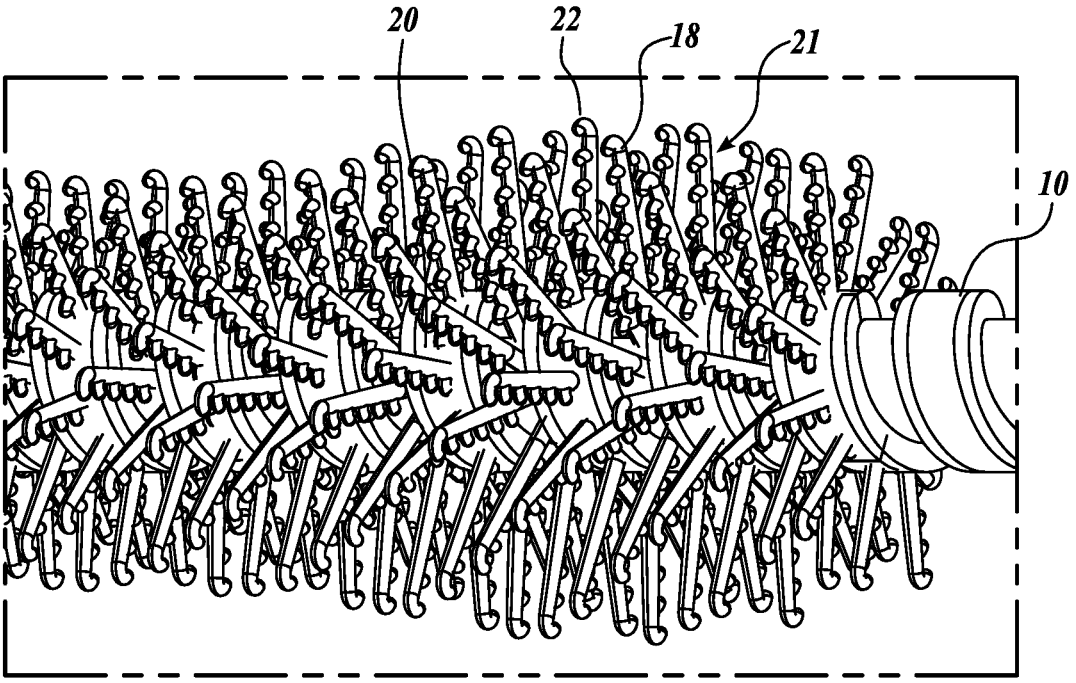
FIG. 5 is an exploded section view of the applicator of FIG. 3, taken at cross-section G.
Figure 6A:
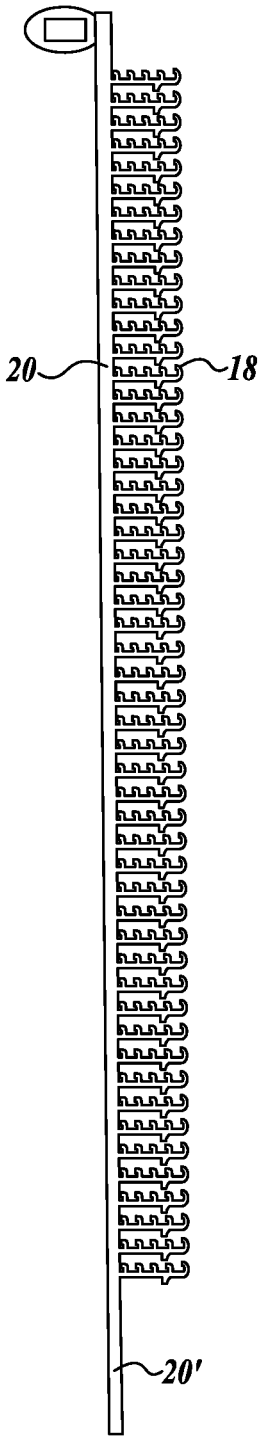
FIG. 6*a* illustrates a view of an embodiment of the elongated strip or strip that is appointed to helically wrap the core of FIG. 2.
Figure 6B:
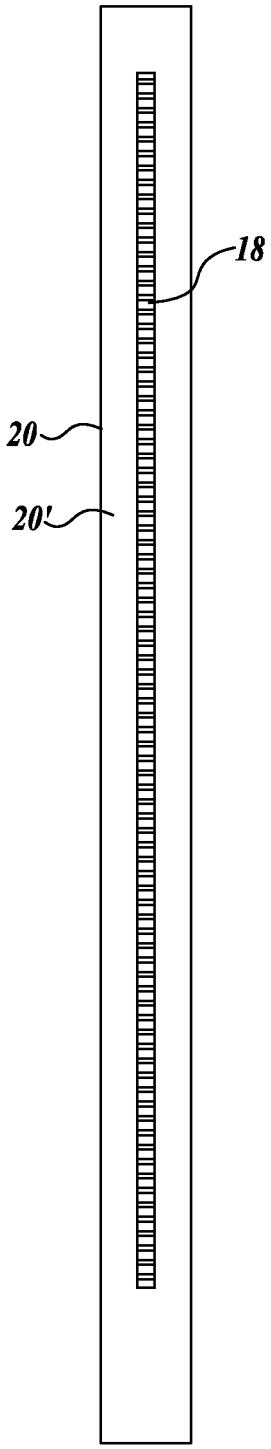
FIG. 6*b* illustrates a top plan view of the elongated strip or strip of FIG. 6*a;*

The microcombs 22 extend from the body at the same height h and are symmetrical with one another forming a sweep rotation around the applicator (see FIG. 4). In the case where the bristles comprise several bristles extending from the same side of the body, they may be identical and be connected to the body at different heights h. In the example shown, the microcombs 22 extending from the same side of the body of the bristle 18 are spaced apart by a distance between 0.05 and 3 mm.

Preferably, the bristles 18 comprise microcombs 22 extending over the upper half of the bristle so as to constitute reserves of product at a height.

In the embodiment described above, the microcombs 22 all have the same shape, but this does not have to be the case. For example, the microcombs 22 may have a different shape, in particular owing to different orientations relative to the core.

Figure 8A:
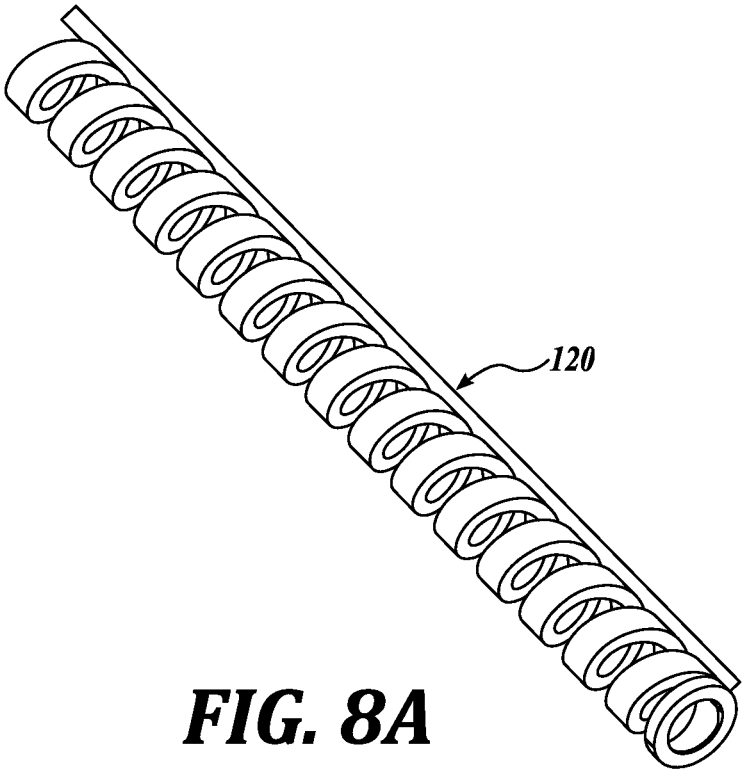
FIG. 8*a* illustrates a spiraled or coiled elongated strip of the subject invention prior to application of the bristles.
Figure 8B:
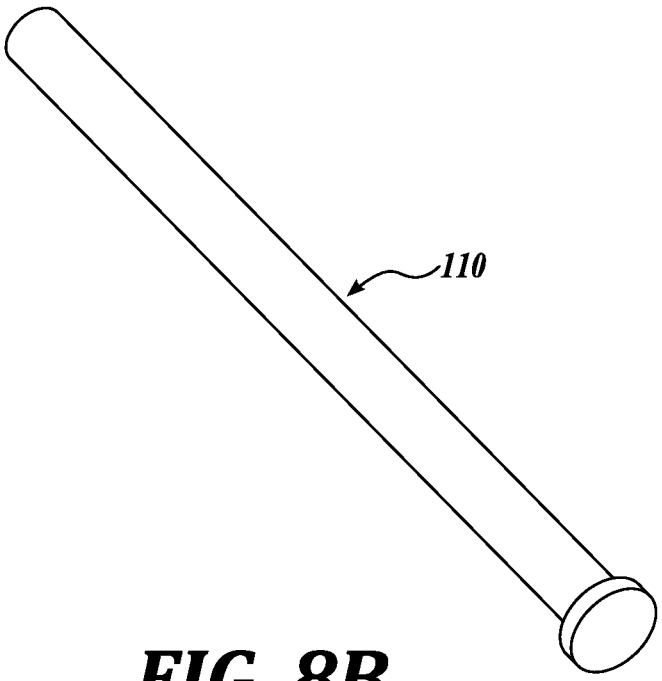
FIG. 8*b* illustrates an embodiment of a core of the subject invention prior to wrapping within the elongated strip.

FIG. 8*a* illustrates a spiraled or coiled elongated ribbon or strip 120 of the subject invention prior to application of the bristles. The plurality of bristles can be molded within the elongated strip 120, or a bristle strip may be bonded or adhered to the elongated strip 120. FIG. 8*b* illustrates an embodiment of a core 110 of the subject invention prior to wrapping within the elongated strip 120.

Figure 9A:
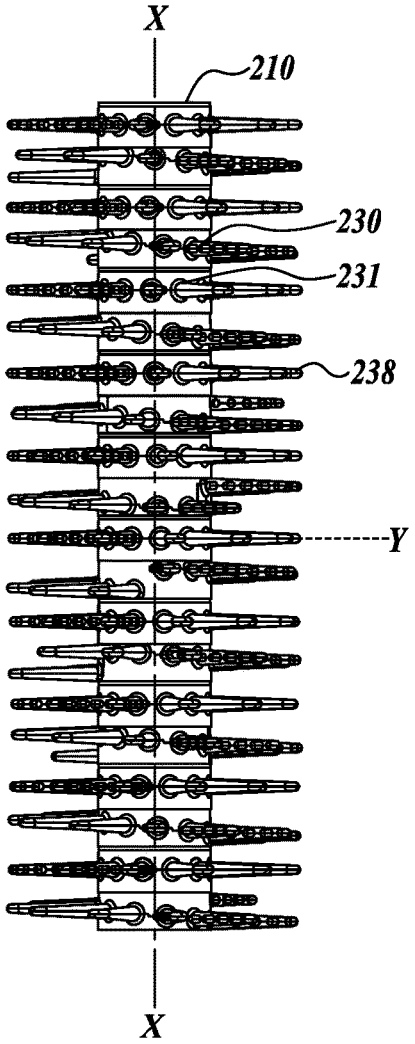
FIG. 9*a* illustrates an embodiment of the subject applicator formed as disks.
Figure 9B:
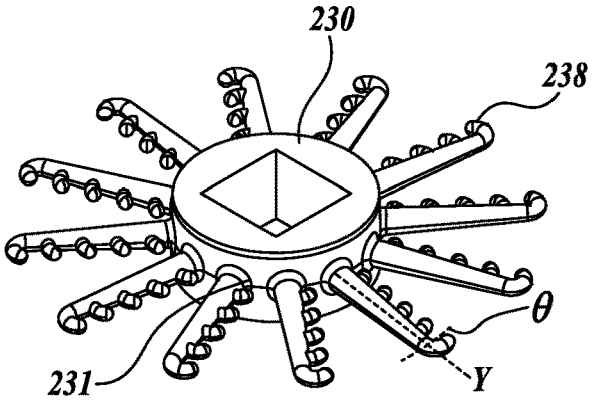
FIG. 9*b* illustrates a disk of FIG. 9*a.*

FIG. 9*a* illustrates an embodiment of the subject applicator formed as disks. FIG. 9*b* illustrates a disk of FIG. 9*a*. An applicator for applying a cosmetic product to the eyelashes and/or eyebrows is shown having a core 210 extending along a longitudinal axis X. One or more disks 230 having a side wall planar surface 231 with a plurality of bristles 238 extending therefrom in a ring are stacked upon one another around the longitudinal axis X of the core 10. Each of the plurality of bristles 238 have a bristle latitudinal axis Y and comprise one or more branches 222 extending at a downward angle θ from the bristle latitudinal axis Y (see FIG. 7).

The term "bristle" denotes individualized bristles, tines or projecting bristles intended to come into engagement with the eyelashes and/or eyebrow.

The "longitudinal axis of the core" denotes the line connecting all of the centers of mass of the cross sections of the core. The longitudinal axis may be a central axis, or even an axis of symmetry for the core, notably when the core has a circular cross section or a cross section in the overall shape of a regular polygon. The longitudinal axis of the core may be rectilinear or curved and may be contained in a plane, which may be a plane of symmetry for some or even for all of the cross sections of the core. Preferably, the longitudinal axis of the core is rectilinear. As an alternative, this core may have one or more curves.

The applicator member may be made of a single thermoplastic material. As an alternative, the applicator member may comprise several materials, notably parts made of different materials fused together at their join during production so as to form just one single part. For example, the core comprises a center of a flexible material covered with a casing of a more rigid material, the two materials being fused together at their joins.

From the foregoing, it will be appreciated that specific embodiments of the technology have been described herein for purposes of illustration, but that various modifications may be made without deviating from the disclosure.

Moreover, while various advantages and features associated with certain embodiments have been described above in the context of those embodiments, other embodiments may also exhibit such advantages and/or features, and not all embodiments need necessarily exhibit such advantages and/or features to fall within the scope of the technology.

Where methods are described, the methods may include more, fewer, or other steps. Additionally, steps may be performed in any suitable order. Accordingly, the disclosure can encompass other embodiments not expressly shown or described herein.

While several embodiments have been illustrated and described, it will be appreciated that various changes can be made therein without departing from the spirit and scope of the inventive technology.

The invention claimed is:

1. An applicator configured for application of a cosmetic product to eyelashes and/or eyebrows, the applicator comprising:

a core that extends along a longitudinal axis X; and an elongated strip that comprises bristles that extend radially outward from the longitudinal axis X of the core along a latitudinal axis Y, wherein the elongated strip is wrapped in a helical pattern around the core;

wherein each bristle of the bristles of the elongated strip comprises branches that extend outward along a length of, and at a downward angle θ from, the latitudinal axis Y of the bristles;

wherein the downward angle θ is at least approximately coplanar with the latitudinal axis Y and a plane defined by an axis Z' (Z'Y plane);

wherein the longitudinal axis X, the latitudinal axis Y, and an axis Z are perpendicular to each other to form an XY plane, an XZ plane, and a YZ plane;

wherein the cosmetic product is loaded into gaps between the branches, and the eyelashes and/or eyebrows are at least partially perpendicular to the XY plane, the cosmetic product is configured to be transferred from the gaps to a full length of the eyelashes and/or eyebrows; and wherein the length is an entirety of the length of the latitudinal axis Y of the bristles, and wherein the downward angle θ is ≤90 degrees.

2. The applicator of claim 1, wherein the downward angle θ ranges from between 45 degrees to 80 degrees.

3. The applicator of claim 1, wherein the branches comprise at least three branches.

4. The applicator of claim 1, wherein the branches are linear.

5. The applicator of claim 1, wherein the branches are curved hooks.

6. The applicator of claim 1, wherein the branches are facing the same direction.

7. The applicator of claim 1, wherein bristle has a diameter ranging from 0.2 mm to 0.8 mm, or ranging from 0.3 mm to 0.5 mm.

8. The applicator of claim 1, wherein the branches have a cross-section length that extends from the bristle ranging from 0.5 mm to 2.5 mm, or ranging from 1 mm to 1.5 mm.

9. The applicator of claim 1, wherein the branches have a thickness ranging from 0.2 mm to 0.8 mm, or ranging from 0.3 mm to 0.5 mm.

10. The applicator of claim 1, wherein the applicator does not comprise any elongated strip in addition to the elongated strip.

11. The applicator of claim 1, wherein the elongated strip, bristles, and branches are composed of a single material.

12. The applicator of claim 1, wherein the elongated strip, bristles, and branches are composed of two or more materials.

13. The applicator of claim 12, wherein the two or more materials have different softness or flexibility properties.

14. The applicator of claim 1, wherein each bristle extends from a top planar surface of the elongated strip at an angle ϕ defined by the latitudinal axis Y and the top planar surface.

15. The applicator of claim 1, wherein a helical gap extends along the core between alternating rows of bristles.

16. The applicator of claim 1, wherein at least one portion of the applicator is made by a 3-D printing technology.

17. The applicator of claim 16, wherein the at least one portion of the applicator is made by a combination of an elastomeric technology and the 3-D printing technology.

18. The applicator of claim 1, wherein at least one portion of the applicator is made by an injection molding technology and/or a bi-injection molding technology.

19. The applicator of claim 1, wherein the bristles are angled relative to the longitudinal axis X at a bristle base along the Z axis by an angle β, ranging between 5 and 30°.

20. The applicator of claim 1, wherein the bristles pass through the core at the bristle base by an angle α relative to the axis Z, ranging between 45° and 90°.

21. An applicator configured for application of a cosmetic product to eyelashes and/or eyebrows, the applicator comprising:

a core that extends along a longitudinal axis X; and a disk that comprises bristles that extend radially outward from the longitudinal axis X of the core along a latitudinal axis Y, wherein the disk is positioned circumferentially around the core;

wherein each bristle of the bristles of the disk comprises branches that extend outward along a length of, and at a downward angle θ from, the latitudinal axis Y of the bristles;

wherein the downward angle θ is at least approximately coplanar with the latitudinal axis Y and a plane defined by an axis Z' (Z'Y plane);

wherein the longitudinal axis X, the latitudinal axis Y, and an axis Z are perpendicular to each other to form an XY plane, an XZ plane, and a YZ plane;

wherein the cosmetic product is loaded into gaps between the branches, and the eyelashes and/or eyebrows are at least partially perpendicular to the XY plane, the cosmetic product is configured to be transferred from the gaps to a full length of the eyelashes and/or eyebrows; and wherein the length is an entirety of the length of the latitudinal axis Y of the bristles, and wherein the downward angle θ is ≤90 degrees.

22. A method for making an applicator configured for application of a cosmetic product to eyelashes and/or eyebrows, the method comprising:

forming a core that extends along a longitudinal axis X;

forming an elongated strip that comprises bristles that extend radially outward from the longitudinal axis X of the core along a latitudinal axis Y, wherein each bristle of the bristles of the elongated strip comprises branches that extend outward along a length of, and at a downward angle θ from, the latitudinal axis Y of the bristles, wherein the downward angle θ is at least approximately coplanar with the latitudinal axis Y and a plane defined by an axis Z' (Z'Y plane);

wherein the longitudinal axis X, the latitudinal axis Y, and an axis Z are perpendicular to each other to form an XY plane, an XZ plane, and a YZ plane; and wrapping the elongated strip in a helical pattern around the core;

wherein the cosmetic product is loaded into gaps between the branches, and the eyelashes and/or eyebrows are at least partially perpendicular to the XY plane, the cosmetic product is configured to be transferred from the gaps to a full length of the eyelashes and/or eyebrows; and wherein the length is an entirety of the length of the latitudinal axis Y of the bristles, and wherein the downward angle θ is ≤90 degrees.

* * * * *